US011866808B2

(12) United States Patent
Hideshima et al.

(10) Patent No.: US 11,866,808 B2
(45) **Date of Patent: *Jan. 9, 2024**

(54) METHOD FOR MANUFACTURING THIXOMOLDING MATERIAL

(71) Applicant: SEIKO EPSON CORPORATION, Tokyo (JP)

(72) Inventors: Yasutoshi Hideshima, Nagano (JP); Hidefumi Nakamura, Aomori (JP); Makoto Kato, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/207,829

(22) Filed: Mar. 22, 2021

(65) Prior Publication Data

US 2021/0291265 A1 Sep. 23, 2021

(30) Foreign Application Priority Data

Mar. 23, 2020 (JP) ..... 2020-050637
Nov. 16, 2020 (JP) ..... 2020-190119

(51) Int. Cl.
*B22F 1/107* (2022.01)
*B22F 1/102* (2022.01)
(Continued)

(52) U.S. Cl.
CPC ..... *C22C 23/02* (2013.01); *B22F 1/102* (2022.01); *B22F 1/107* (2022.01); *B22F 1/142* (2022.01);
(Continued)

(58) Field of Classification Search
CPC ..... C22C 23/00; C22C 23/02; C22C 23/04; C22C 23/06; B22F 1/00; B22F 1/09; B22F 1/10; B22F 1/102; B22F 1/103; B22F 1/105; B22F 1/107; B22F 1/12; B22F 1/0003; B22F 9/00; B22F 9/02; B22F 9/026; B22F 9/04; B22F 2009/001; B22F 2301/058; B22F 2302/40; B22F 2302/403; B22F 2302/406; B22F 2303/01; B22F 2303/20; B22F 2303/25; B22F 1/108;
(Continued)

(56) References Cited

U.S. PATENT DOCUMENTS 6,126,712 A * 10/2000 Hohne ..... B22F 1/148 75/246
2002/0040077 A1* 4/2002 Hanejko ..... C23C 26/00 427/372.2
(Continued)

FOREIGN PATENT DOCUMENTS

CN 101439405 A 5/2009
JP 2012/137907 A 7/2014
(Continued)

*Primary Examiner* — Vanessa T. Luk
(74) *Attorney, Agent, or Firm* — Global IP Counselors, LLP

(57) ABSTRACT

A method for manufacturing a thixomolding material for thixomolding includes a drying step of heating a mixture containing a first powder that contains Mg as a main component, a second powder, a binder, and an organic solvent to dry the organic solvent contained in the mixture, and a stirring step of stirring the mixture heated in the drying step.

5 Claims, 3 Drawing Sheets

(51) Int. Cl.

| | |
|---|---|
| ***B22F 1/142*** | (2022.01) |
| ***B22F 1/16*** | (2022.01) |
| ***B22F 1/105*** | (2022.01) |
| ***C22C 23/02*** | (2006.01) |

(52) U.S. Cl.
CPC ..... *B22F 1/16* (2022.01); *B22F 1/105* (2022.01); *B22F 2301/058* (2013.01)

(58) Field of Classification Search
CPC .. B22F 1/14; B22F 1/142; B22F 1/145; B22F 1/147; B22F 1/148; B22F 1/16; B22F 1/17; B22F 1/18
See application file for complete search history.

(56) References Cited

U.S. PATENT DOCUMENTS

| | | | | |
|---|---|---|---|---|
| 2006/0034723 | A1* | 2/2006 | Poszmik | B22F 1/10 419/10 |
| 2006/0057015 | A1 | 3/2006 | Kondoh | |
| 2006/0219056 | A1* | 10/2006 | Larink, Jr. | B22F 9/026 75/338 |
| 2008/0213118 | A1 | 9/2008 | Kondoh | |
| 2014/0023547 | A1 | 1/2014 | Mitooka et al. | |
| 2016/0074942 | A1* | 3/2016 | Fang | B22F 3/24 75/245 |

FOREIGN PATENT DOCUMENTS

| | | | | |
|---|---|---|---|---|
| KR | 1020160106843 | A * | 9/2016 | B22F 1/16 |
| WO | 2004/062837 | A1 | 5/2006 | |

* cited by examiner

FIG. 3

| | EXAMPLE AND COMPARATIVE EXAMPLE | FEED AMOUNT OF BINDER (%) | FEED AMOUNT OF POWDER C (%) | DRYING TEMPERATURE (°C) | DRYING TIME (min) | THE NUMBER OF REPETITIONS | DEBINDERING TEMPERATURE (°C) | DEBINDERING TIME (min) | ATTACHMENT AMOUNT (%) | ATTACHMENT RATIO (%) | REMAINING BINDER WEIGHT |
|---|---|---|---|---|---|---|---|---|---|---|---|
| SAMPLE 1 | EXAMPLE | 7 | 10 | 65 | 120 | 4 | 400 | 120 | 9.5 | 95 | A |
| SAMPLE 2 | EXAMPLE | 7 | 10 | 65 | 120 | 4 | 250 | 720 | 9.6 | 96 | A |
| SAMPLE 3 | COMPARATIVE EXAMPLE | 7 | 10 | 65 | 120 | 4 | — | — | 9.6 | 96 | B |
| SAMPLE 4 | EXAMPLE | 7 | 10 | 65 | 120 | 1 (CONTINUOUS) | 350 | 120 | 9.4 | 94 | A |
| SAMPLE 5 | EXAMPLE | 7 | 10 | 55 | 240 | 6 | 350 | 120 | 9.7 | 97 | A |
| SAMPLE 6 | EXAMPLE | 7 | 10 | 75 | 60 | 3 | 350 | 120 | 9.2 | 92 | A |
| SAMPLE 7 | EXAMPLE | 10 | 20 | 75 | 60 | 3 | 350 | 120 | 18.8 | 94 | A |
| SAMPLE 8 | EXAMPLE | 12 | 30 | 75 | 60 | 3 | 350 | 120 | 27.9 | 93 | A |
| SAMPLE 9 | COMPARATIVE EXAMPLE | — | 10 | 65 | 120 | 4 | 350 | 120 | 3.3 | 33 | A |
| SAMPLE 10 | COMPARATIVE EXAMPLE | — | 10 | 65 | 120 | 4 | — | — | 3.8 | 38 | A |
| SAMPLE 11 | COMPARATIVE EXAMPLE | — | 10 | 65 | 102 | 1 (CONTINUOUS) | 350 | 120 | 3.5 | 35 | A |
| SAMPLE 12 | COMPARATIVE EXAMPLE | — | 20 | 75 | 60 | 3 | 350 | 120 | 3.5 | 18 | A |

METHOD FOR MANUFACTURING THIXOMOLDING MATERIAL

The present application is based on, and claims priority from JP Application Serial Number 2020-050637, filed Mar. 23, 2020, and JP Application Serial Number 2020-190119, filed Nov. 16, 2020, the disclosure of which is hereby incorporated by reference herein in its entirety.

BACKGROUND

1. Technical Field

The present disclosure relates to a method for manufacturing a thixomolding material.

2. Related Art

In recent years, parts made of magnesium alloy have been used in products such as automobiles, aircrafts, mobile phones, notebook computers, and the like. Since magnesium has a higher specific strength than iron, aluminum, and the like, the parts manufactured using the magnesium alloy can be lightweight and have a high strength. In addition, magnesium is abundant near a surface of the earth, so there is an advantage in terms of resource acquisition.

One method of manufacturing the parts made of magnesium includes thixomolding. In the thixomolding, since a material whose fluidity is increased by heating and shearing is injected into a mold, it is possible to mold a thin part or a part having a complicated shape compared to a die casting method. In addition, since the material is injected into the mold without coming into contact with an atmosphere, there is an advantage that a molded product can be molded without using a flame-retardant gas such as SF6.

For example, WO2012/137907 discloses a technique of coating a surface of a magnesium alloy material with a carbon powder in order to improve a bending characteristic and a tensile strength of a molded product by thixomolding. In WO2012/137907, 100 g, that is, 0.1 mass % of carbon black is added to 100 kg of a magnesium alloy chip, and both of them are mixed by a mixer, so that a surface of the magnesium alloy chip is coated with the carbon powder.

An amount of an additive such as the carbon powder coating the magnesium alloy material is preferably an amount at which a desired characteristic of the molded product can be implemented. Therefore, it may be desired to coat the magnesium alloy material with more additives in order to implement the desired characteristic of the molded product.

SUMMARY

According to a first aspect of the present disclosure, a method for manufacturing a thixomolding material is provided. The manufacturing method includes a drying step of heating a mixture containing a first powder that contains Mg as a main component, a second powder, a binder, and an organic solvent to dry the organic solvent contained in the mixture; and a stirring step of stirring the mixture heated in the drying step.

BRIEF DESCRIPTION OF THE DRAWINGS

FIG. 3 shows evaluation results of the thixomolding material.

DESCRIPTION OF EXEMPLARY EMBODIMENTS

A. Embodiment

Figure 1:
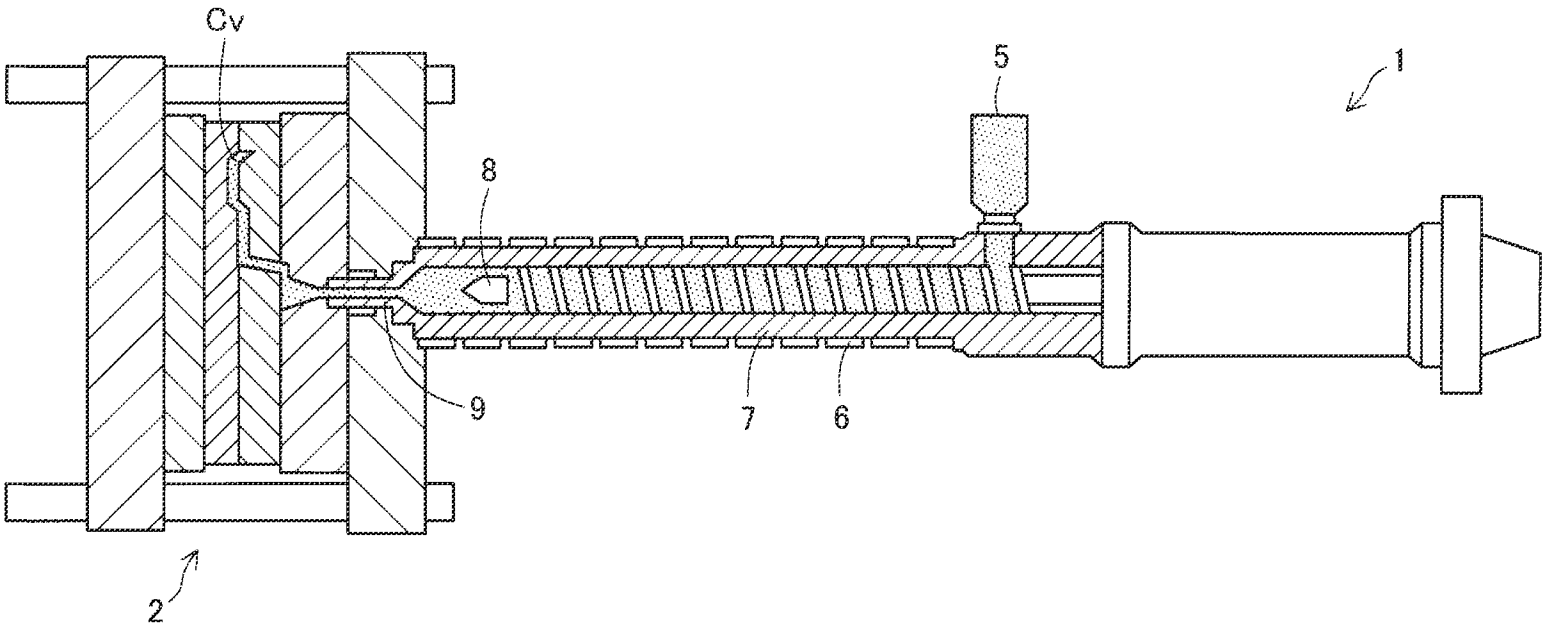
FIG. 1 is a schematic view showing an example of a configuration of an injection molding machine.

FIG. 1 is a schematic view showing an example of a configuration of an injection molding machine 1 used in thixomolding. The thixomolding is a method in which a material having a chip shape or a material such as a powder is formed into a slurry by heating and shearing, and the slurry is injected without coming into contact with an atmosphere to obtain a molded product having a desired shape. In the thixomolding, the molded product is generally molded at a lower temperature as compared to a die casting method and the like, and a structure of the molded product is likely to be uniform. Therefore, a mechanical strength and a dimensional accuracy of the molded product can be improved by molding the molded product by the thixomolding. In the present specification, a term "molded product" refers to a product molded by the thixomolding when being simply used.

The molded product obtained by the thixomolding is used for parts constituting various products. The molded product is used, for example, in an electronic device part such as a personal computer part, a mobile phone terminal part, a smartphone part, a tablet terminal part, a wearable device part, and a camera part, various structures such as an ornament, an artificial bone, and an artificial tooth root in addition to a transportation device part such as an automobile part, a railroad vehicle part, a ship part, and an aircraft part.

As shown in FIG. 1, the injection molding machine 1 includes a mold 2 that forms a cavity Cv, a hopper 5, a heating cylinder 7 including a heater 6, a screw 8, and a nozzle 9. When the thixomolding is performed by the injection molding machine 1, first, the material is fed into the hopper 5. The fed material is supplied from the hopper 5 to the heating cylinder 7. The material supplied to the heating cylinder 7 is formed into a slurry by being heated in the heating cylinder 7 by the heater 6, and being sheared while being transferred by the screw 8. The slurry is injected through the nozzle 9 into the cavity Cv in the mold 2 without coming into contact with the atmosphere.

Figure 2:
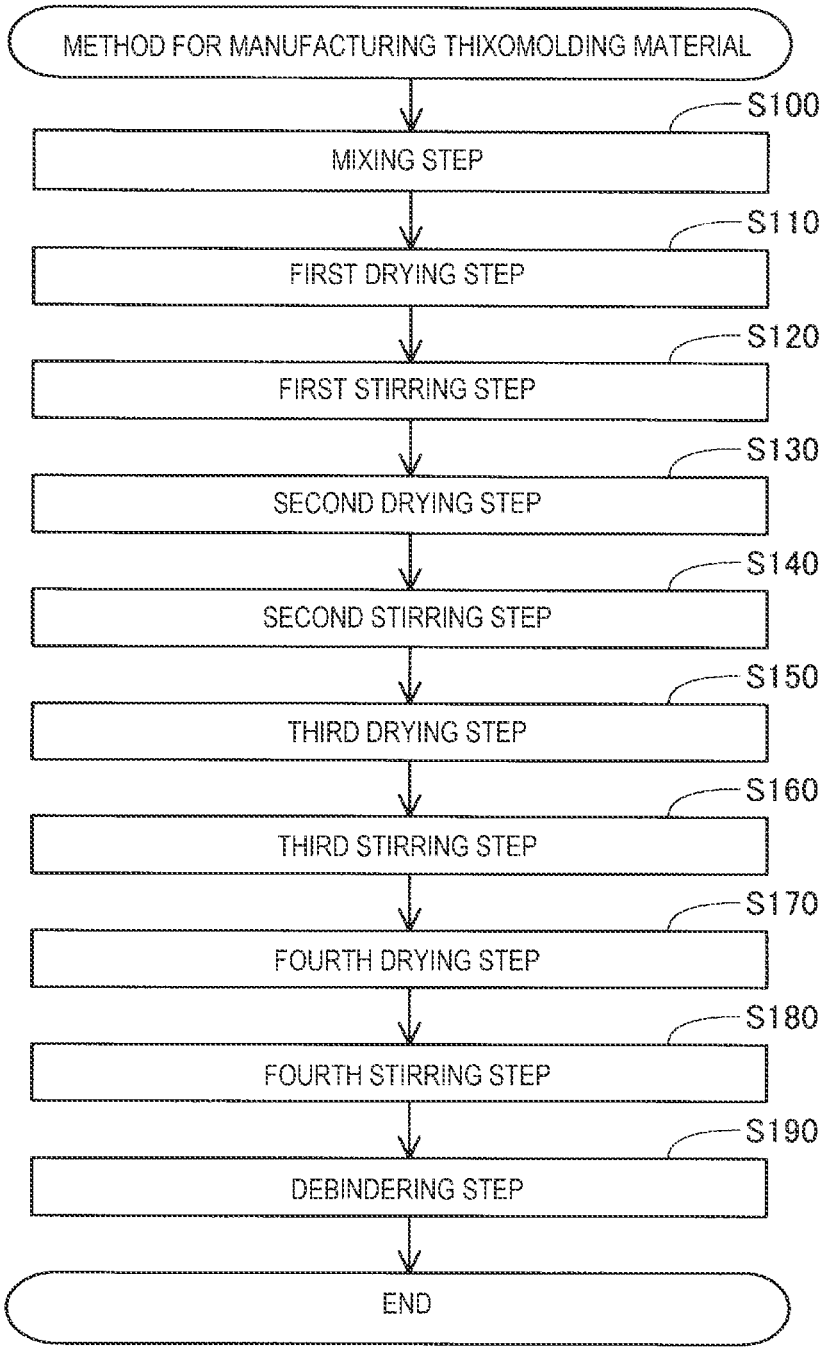
FIG. 2 is a step diagram showing a method for manufacturing a thixomolding material.

FIG. 2 is a step diagram showing a method for manufacturing a thixomolding material in the present embodiment. The thixomolding material of the present embodiment is used as a material for the above-described thixomolding.

First, in step S100, a mixture is generated. In step S100, by mixing a first powder containing magnesium (Mg) as a main component, a second powder, a binder, and an organic solvent, the mixture containing them is generated. The main component refers to a substance having a highest content rate among substances contained in the first powder and the second powder.

The first powder refers to a metal grain of a Mg alloy having a substantially spherical or scaly shape. The first powder is preferably manufactured by an atomizing method, and more preferably manufactured by a high-speed rotating water flow atomizing method. Examples of the atomizing method include a water atomizing method and a gas atomizing method in addition to the high-speed rotating water flow atomizing method. Further, the first powder may be manufactured by a method other than the atomizing method, and may be manufactured by, for example, a reduction method and a carbonyl method.

In the high-speed rotating water flow atomizing method, first, a coolant layer is formed on an inner peripheral surface of a cooling cylinder by ejecting and supplying a coolant along the inner peripheral surface and swirling the coolant along the inner peripheral surface of the cooling cylinder. Further, a raw material of the Mg alloy is melted, and the obtained molten metal is naturally dropped while a liquid or gas jet is sprayed onto the molten metal. Accordingly, the molten metal is scattered and miniaturized, and the molten metal is blown off to the coolant layer and taken into the coolant layer. As a result, the scattered and miniaturized molten metal is rapidly cooled and solidified to obtain a Mg alloy powder. In the high-speed rotating water flow atomizing method, since the raw material in a molten state is rapidly cooled in a short time, a crystal structure of the material is finer. As a result, a powder capable of molding the molded product having an excellent mechanical characteristic can be obtained.

A pressure at a time of ejecting the coolant supplied to the cooling cylinder is preferably 50 MPa or more and 200 MPa or less. Further, a temperature of the coolant is preferably −10° C. or higher and 40° C. or lower. Accordingly, the scattered molten metal is cooled appropriately and evenly in the coolant layer.

A melting temperature at which the raw material of the Mg alloy is melted is preferably set, with respect to a melting point Tm of the Mg alloy, to Tm+20° C. or higher and Tm+200° C. or lower, and more preferably set to Tm+50° C. or higher and Tm+150° C. or lower. Accordingly, a variation in characteristics among particles constituting the Mg alloy powder can be reduced to be particularly small.

In the high-speed rotating water flow atomizing method, for example, a particle size, a tap density, an average DAS, and the like of the produced Mg alloy powder can be adjusted by adjusting various conditions. The "average DAS" refers to average dendrite secondary arm spacing. For example, the average DAS can be reduced by increasing a flow velocity or a flow rate of the coolant. In addition, by adjusting a flow-down amount of the molten metal, a flow velocity of the liquid or gas jet, or the flow velocity or the flow rate of the coolant, a thickness of an oxide layer, the particle size, a shape, and the tap density of the Mg alloy powder can be adjusted.

In the high-speed rotating water flow atomizing method, the molten metal may reach the coolant layer directly without using the liquid or gas jet. In this case, for example, a cooling housing is disposed so as to be inclined to a direction of free fall of the molten metal. Accordingly, the molten metal reaches the coolant layer by free fall and is taken into the coolant layer. In a case of such a configuration, the molten metal is miniaturized and cooled and solidified by a flow of the coolant layer to obtain the Mg alloy powder having a relatively large particle size.

The first powder may contain various additive components in addition to Mg as the main component. The first powder may contain, for example, calcium (Ca) as the additive component. When Ca is contained in the first powder, an ignition temperature of the first powder increases. Further, the first powder may contain, for example, aluminum (Al) as the additive component. When Al is added in the first powder, a melting point of the first powder decreases.

In addition to Ca and Al described above, the first powder may contain other components as the additive components. Examples of the other components include, for example, lithium, beryllium, silicon, manganese, iron, nickel, copper, zinc, strontium, yttrium, zirconium, silver, tin, gold, and rare earth elements such as cerium, and one kind or two or more kinds of them may be added. The other component is more preferably at least one selected from a group including manganese, yttrium, strontium, and rare earth elements. By adding these additive components to a Mg chip, a mechanical property, corrosion resistance, wear resistance, and thermal conductivity of the Mg chip can be improved.

The above-described additive components may be present, for example, in a state of a simple substance, an oxide, an intermetallic compound, and the like in the first powder or the thixomolding material. Further, in the first powder or the thixomolding material, for example, the additive components may be segregated at a crystal grain boundary of a metal structure such as Mg or the Mg alloy, or may be uniformly dispersed.

A section obtained by machining or cutting the Mg alloy cast in a mold and the like of the above-described first powder may be referred to as a chip. Examples of the chip include a chip of 4 mm×2 mm×2 mm of AZ91D manufactured by STU, Ltd. The chip is a Mg alloy chip containing 9 mass % of Al and 1 mass % of Zn. The chip may also be referred to as a pellet.

In the present embodiment, a SEAST "116" manufactured by Tokai Carbon Co., Ltd. is used as the second powder. The SEAST "116" is a carbon black having an arithmetic average particle diameter of 38 nm. The second powder may be, for example, another carbon black, a ceramic powder, or a metal powder.

In the present embodiment, a paraffin wax "115" manufactured by Nippon Seiyaku Co. is used as the binder. An organic binder other than the paraffin wax "115" may be used as the binder. In this case, for example, a hydrocarbon resin-based hot melt adhesive may be used, or another type of organic binder may be used. Further, for example, an inorganic binder such as a binder containing an inorganic polymer such as an alkali silicate may be used as the binder.

In the present embodiment, isopropanol (IPA) is used as the organic solvent. An organic solvent other than the IPA may be used as the organic solvent. In this case, it is preferable to use the organic solvent suitable for dispersing the organic binder. For example, acetone and the like can be used as the organic solvent.

In manufacture of the thixomolding material, step S100 may be omitted. For example, a mixture in which the first powder, the second powder, the organic binder, and the organic solvent described above are mixed in advance is prepared in advance, and the prepared mixture may be used after step S110.

In step S110, a first drying step is performed. A drying step is a step of heating the mixture to dry the organic solvent contained in the mixture. The first drying step refers to a drying step performed at a first time in the manufacture of the thixomolding material of the present embodiment. Similarly, a second drying step, a third drying step, and a fourth drying step to be described later also refer to the drying step performed at a second, a third, and a fourth time, respectively.

In step S120, a first stirring step is performed. A stirring step is a step of stirring the mixture heated in the drying step. The first stirring step refers to a stirring step performed at a first time in the manufacture of the thixomolding material of the present embodiment. Similarly, a second stirring step, a third stirring step, and a fourth stirring step to be described later also refer to the stirring steps performed at a second, a third, and a fourth time, respectively. In the stirring step, for example, the mixture may be directly stirred with a stirring rod or a stirrer, or the mixture in a container may be stirred by shaking the container containing the mixture.

In step S130, the second drying step is performed, and in step S140, the second stirring step is performed. Next, in step S150, the third drying step is performed, and in step S160, the third stirring step is performed. Further, in step S170, the fourth drying step is performed, and in step S180, the fourth stirring step is performed.

By performing the above-described first drying step to the fourth drying step and the first stirring step to the fourth stirring step, the second powder is attached to the first powder. The "attachment" includes a state in which the second powder is directly attached to the first powder, and a state in which the second powder is attached to the first powder via another element such as the binder. Further, the second powder may be attached to the first powder in a multilayer manner. In the present embodiment, by attaching the second powder to the first powder not only directly but also via the binder, an amount of the second powder attached to the first powder is improved as compared with a case where the binder is not used. The state "in which the second powder is attached to the first powder" may be referred to as a state "in which the second powder modifies the first powder". In addition, the state "in which the second powder is attached to the first powder" may be referred to as a state "in which the second powder covers the first powder".

In the present embodiment, as described above, the drying steps and the stirring steps are alternately performed a plurality of times. Accordingly, the second powder is likely to be attached to the first powder in the multilayer manner.

In step S190, a debindering step is performed. The debindering step is a step of heating the mixture to remove at least a part of the organic binder contained in the mixture. In the present embodiment, in the debindering step, the mixture is heated at a debindering temperature of 250° C. or higher and 450° C. or lower.

The method for manufacturing the thixomolding material of the present embodiment described above includes the stirring step of stirring the mixture containing the first powder, the second powder, the binder, and the organic solvent, and a drying step of heating the mixture to dry the organic solvent contained in the mixture. Therefore, the amount of the second powder that modifies the first powder is improved as compared to the case where the binder is not used.

Further, in the present embodiment, the drying steps and the stirring steps are alternately performed the plurality of times. Therefore, the second powder is likely to be attached to the first powder in the multilayer manner, and the amount of the second powder that modifies the first powder is stabilized.

Further, in the present embodiment, after the stirring steps and the drying steps are completed, the debindering step is performed. Therefore, during molding, generation of a gas derived from the binder from the thixomolding material is reduced, and a molding accuracy of the molded product is improved.

Further, in the present embodiment, in the debindering step, the mixture is heated at the temperature of 250° C. or higher and 450° C. or lower. Therefore, in the debindering step, since the mixture is heated at a temperature lower than the melting point of Mg, the binder is effectively debindered and a thermal influence on the first powder is reduced.

In another embodiment, in the manufacture of the thixomolding material, the drying steps and the stirring steps may not be performed four times alternately. For example, the drying step and the stirring step may be performed once. Further, the number of times the drying steps and stirring steps are performed may be two or three, or five or more, respectively. The number of times the drying steps and the stirring steps are repeated may be referred to as the number of times of repetition. In the manufacturing method shown in FIG. 2, the number of times of repetition is four. Further, for example, the drying step and the stirring step may be performed at the same time, and the stirring step may be performed a plurality of times or once while the drying step is continuously performed. Further, a timing at which the stirring step is performed may be determined by an experiment.

In another embodiment, the debindering temperature may be less than 250° C. or may be greater than 450° C. In this case, the debindering temperature is preferably lower than the melting point of Mg. Further, for example, the debindering step may not be performed. Even in this case, the amount of the second powder that modifies a first powder surface is improved compared to the case where the binder is not used.

B. Evaluation Results

FIG. 3 shows evaluation results of the thixomolding material manufactured in accordance with the manufacturing method shown in FIG. 2. FIG. 3 shows a feed amount of the binder and a feed amount of the second powder in a mixing step, a drying temperature and a drying time in the drying step, the number of times of repetition of the stirring step and the drying step, and a debindering temperature and a debindering time in the debindering step when the thixomolding material is manufactured as a sample. Further, FIG. 3 shows an attachment amount of the second powder, an attachment ratio of the second powder, and a remaining binder weight in the manufactured thixomolding material. Details of the attachment amount and the attachment ratio of the second powder and the remaining binder weight will be described in detail later.

A sample 1 to a sample 8 were manufactured in accordance with the manufacturing method shown in FIG. 2. A sample having the number of times of repetition other than four was also manufactured through the same steps as those of the manufacturing method shown in FIG. 2 except that the number of times of repetition was different. First, in the mixing step of step S100, 500 g of the first powder, the second powder, and the binder dispersed in 35 ml of the organic solvent were fed into a container-with-lid kept warm at a mixing temperature by a thermostatic oven to generate the mixture. The feed amounts of the second powder and the binder are shown in FIG. 3 as a ratio to the first powder for each sample. For example, in the sample 1, since an addition amount of the second powder is 10%, a mass of the fed second powder is 50 g.

First, the first powder was obtained by melting a raw material in a high-frequency induction furnace and powdering the raw material by the high-speed rotating water flow atomizing method. At this time, an ejection pressure of the coolant was set to 100 MPa, a temperature of the coolant was set to 30° C., and a temperature of the molten metal was set to the melting point of the raw material+20° C. The obtained first powder contained 9.5 mass % of aluminum, 0.25 mass % of calcium, and Mg as the main component in the balance. The SEAST "116" manufactured by Tokai Carbon Corporation was used as the second powder. The paraffin wax "115" manufactured by Nippon Seiyaku Co. was used as the binder. The IPA is used as the organic solvent.

Next, as steps corresponding to step S110 to step S180 shown in FIG. 2, the drying steps and the stirring steps were performed. Specifically, in the drying step, the organic solvent of the mixture was dried by keeping the mixture at the drying temperature and allowing the drying time to elapse in a state in which a lid of the container-with-lid placed in the thermostatic oven was opened. In the drying step, a time per drying step was determined by dividing a time of entire drying steps by the number of times of repetition. For example, in the sample 1, since the number of times of repetition is four, each time from the first drying step to the fourth drying step is set to one quarter of the drying time in the entire drying steps. Specifically, in the sample 1, since the drying time is 120 minutes, the respective times of the first drying step to the fourth drying step are 30 minutes. In the sample 5, since the drying time is 240 minutes and the number of times of repetition is six, the respective times of the first drying step to a sixth drying step are 40 minutes. The drying time and drying temperature of the entire drying steps are shown in FIG. 3 for each sample.

Further, as the stirring step, the stirring step was performed the number of times corresponding to the number of times of repetition. Specifically, in the sample in which the number of times of repetition was two or more, each of the drying steps was completed, and then each of the stirring steps was performed. For example, in the sample 1, after each of the first drying step to the fourth drying step was completed, each of the first stirring step to the fourth stirring step was performed. In the sample 5, after each of the first drying step to the sixth drying step was completed, each of the first stirring step to a sixth stirring step was performed. In the stirring step, the mixture in the container-with-lid was stirred by closing the lid of the container-with-lid and shaking the container-with-lid.

In manufacture of the sample in which the number of times of repetition shown in FIG. 3 is one, the drying step and the stirring step were performed at the same time. For example, in the sample 4, while the drying step was continuously performed once for 120 minutes, the stirring step was continuously performed once for 120 minutes.

After the drying step and the stirring step were completed, the same debindering step as in step S190 was performed. Specifically, in the debindering step, the sample was debindered by heating the sample in an electric furnace. The debindering temperature and the debindering time in the debindering step are shown in FIG. 3 for each sample. In manufacture of the sample 3, the debindering step was not performed after the drying step and the stirring step were completed.

Samples 9 to 12 were manufactured without using the binder. That is, in manufacture of the sample 9 to sample 12, as a step corresponding to step S100 of FIG. 2, a step of mixing only the first powder, the second powder, and the organic solvent was performed. Then, the steps after step S110 were performed in a similar manner as in the case of manufacturing the sample 1 to the sample 8, and the sample 9 to the sample 12 were obtained. In manufacture of the sample 10, the debindering step was not performed after the drying step and the stirring step were completed.

The attachment amount of the second powder in FIG. 3 indicates a ratio of a mass of the second powder attached to the first powder with respect to a mass Mp1 of the fed first powder. The attachment ratio of the second powder indicates a ratio of a mass of the second powder attached to the first powder with respect to a mass Mp2 of the fed second powder.

The attachment amount and the attachment ratio of the second powder were evaluated by measuring masses before and after washing of the thixomolding material. Specifically, first, as a mass M1 before the washing, the mass of the thixomolding material immediately after being manufactured in accordance with the manufacturing method described above was measured. Then, the thixomolding material was impregnated in acetone, washed with an ultrasonic cleaner for 10 minutes, dried, and then the mass of the thixomolding material was measured, and this mass was taken as a mass M2 after the washing. At this time, the attachment amount of the second powder is represented by $(M2-M1)/Mp1\times100\%$. The attachment ratio of the second powder is represented by $(M2-M1)/Mp2\times100\%$. For example, when an organic binder other than the paraffin wax "115" is used in the manufacture of the sample, a cleaning agent for cleaning the sample may not be acetone. In this case, as the cleaning agent, a cleaning agent capable of washing the binder and the second powder without reacting with the first powder is used.

As shown in FIG. 3, when the sample 1 to the sample 6 each having the feed amount of the second powder of 10 mass % and the sample 9 to the sample 12 were compared, the attachment amounts and the attachment ratios of the sample 1 to the sample 6 were larger than the attachment amounts and the attachment ratios of the sample 9 to the sample 12. When the sample 7 and the sample 12 each having the feed amount of the second powder of 20 mass % were compared, the attachment amount and the attachment ratio of the sample 7 were larger than the attachment amount and the attachment ratio of the sample 12. The feed amount of the second powder in the sample 8 was larger than the feed amounts of the second powder in the sample 9 to sample 12, and the attachment amount and the attachment ratio in the sample 8 were larger than the attachment amounts and the attachment ratios in the sample 9 to the sample 12. Further, when the sample 1 to the sample 8 were compared, even when the feed amount of the second powder was added, the attachment amount of 92% or more was implemented.

In the sample 1 to the sample 8, it is assumed that the second powder was attached to the first powder via the binder, so that the attachment amounts and the attachment ratios were larger than the attachment amounts and the attachment ratios of the sample 9 to the sample 12.

From the above experimental results, it was confirmed that in the sample manufactured in accordance with the manufacturing method of the above-described embodiment, the amount of the second powder that modifies the first powder surface was improved compared to a sample manufactured by a method without using the binder.

The remaining binder weight in FIG. 3 was evaluated by measuring a thermal weight change of the first powder to which the second powder was attached. Specifically, a weight of the thixomolding material was measured while heating the material immediately after being manufactured in accordance with the manufacturing method described above. When the thixomolding material is heated and the weight is measured, a differential thermal and thermal gravimetric analyzer (TGA/DSC1LF made by Mettler Toledo) was used, and a temperature rise rate was set to 10 [° C./sec]. The gas derived from the binder contained in the thixomolding material is generated, and the weight of the thixomolding material is reduced. When the thixomolding material is further heated, oxidation of the first powder is started, and the weight is increased. A difference between a weight of the thixomolding material when being heated at 200° C. and a minimum weight when being heated at 400° C. to 450° C. was used as the remaining binder weight. In FIG. 3, a case in which the remaining binder weight was 3% or less of the weight of the thixomolding material before being heated was determined as "A", and a case in which the remaining binder weight exceeded 3% was determined as "B".

Comparing the sample 1 to the sample 8 into which the binder was fed as shown in FIG. 3, it was confirmed that the sample 1, the sample 2, and the sample 4 to the sample 8 in which the debindering step was performed had a lower residual binder amount than the sample 3 in which the debindering step was not performed.

In the sample 1, the sample 2, and the sample 4 to the sample 8, it is assumed that an amount of gas generated by heating the thixomolding material was reduced by the debindering step being performed at a debindering temperature of 250° C. or higher.

The thixomolding material is fed into the injection molding machine 1, and the chip is melted in the injection molding machine. When the generation of the gas derived from the binder as described above can be reduced, an increase in the pressure in the injection molding machine such as the heating cylinder 7 can be reduced.

C. Other Aspects

The present disclosure is not limited to the above-described embodiment, and can be implemented in various aspects without departing from the spirit of the present disclosure. For example, the present disclosure can be implemented by the following aspects. In order to solve a part or all of the problems of the present disclosure, or to achieve a part or all of effects of the present disclosure, technical characteristics in the above-described embodiment corresponding to technical characteristics in each of aspects to be described below can be replaced or combined as appropriate. Further, the technical characteristics can be deleted as appropriate unless the technical characteristics are described as essential in the present specification.

(1) According to a first aspect of the present disclosure, the method for manufacturing the thixomolding material is provided. The method for manufacturing the thixomolding material includes the drying step of heating the mixture containing the first powder containing Mg as the main component, the second powder, the binder, and the organic solvent to dry the organic solvent contained in the mixture, and the stirring step of stirring the mixture heated in the drying step.

According to such an aspect, the amount of the second powder that modifies the first powder surface is improved as compared to the case where the organic binder is not used.

(2) In the method for manufacturing the thixomolding material of the above-described aspect, the second powder contains C as the main component. According to such an aspect, the amount of the second powder that modifies the first powder surface is improved even when the second powder contains C as the main component.

(3) In the method for manufacturing the thixomolding material of the above-described aspect, the drying steps and the stirring steps are alternately performed a plurality of times. According to such an aspect, the second powder is likely to be attached to the first powder in the multilayer manner, and the amount of the second powder that modifies the first powder is stabilized.

(4) In the method for manufacturing the thixomolding material of the above-described aspect, the drying steps and the stirring steps may be performed at the same time. According to such an aspect, since the drying step and the stirring step can be performed efficiently with a simple method, it is possible to efficiently manufacture the thixomolding material in which the amount of the second powder that modifies the first powder surface is improved.

(5) In the method for manufacturing the thixomolding material of the above-described aspect, after the stirring step and the drying step are completed, the debindering step of heating the mixture and debindering at least a part of the binder contained in the mixture may be performed. According to such an aspect, the generation of the gas derived from the binder from the thixomolding material during the molding is reduced, and the molding accuracy of the molded product is improved. Further, when the powder modified magnesium alloy chip of the above-described aspect is used in a molded article manufactured by the injection molding method, in a step of melting the chip in the injection molding machine, the generation of the gas derived from the binder in the injection molding machine such as the heating cylinder 7 can be reduced. In this case, it is possible to prevent the pressure inside the injection molding machine from rising due to the generation of the gas.

(6) In the method for manufacturing the thixomolding material of the above-described aspect, in the debindering step, the mixture is heated at the temperature of 250° C. or higher and 450° C. or lower. According to such an aspect, since the mixture is heated at a temperature lower than the melting point of Mg, the binder is effectively debindered and a thermal effect on the first powder is reduced.

The present disclosure is not limited to the above-described thixomolding mixed material, and can be implemented in various forms. For example, the present disclosure can be implemented in a form of a molded product including the thixomolding mixed material.

What is claimed is:

1. A method for manufacturing a thixomolding material comprising:

a drying step of heating a mixture containing a first powder that contains Mg as a main component, a second powder that contains C as a main component, a binder, and an organic solvent to dry the organic solvent contained in the mixture so that the second powder covers the first powder with the second powder being attached to a surface of the first powder;

a stirring step of stirring the mixture heated in the drying step; and a debindering step of debindering at least a part of the binder contained in the mixture so that an attachment amount of the second powder attached to the first powder is 9.2% or greater and 27.9% or less after removal of the part of the binder, the attachment amount being a ratio of a mass of the second powder attached to the first powder with respect to a mass of the first powder.

2. The method for manufacturing the thixomolding material according to claim 1, wherein the drying step and the stirring step are alternately performed a plurality of times.

3. The method for manufacturing the thixomolding material according to claim 1, wherein the drying step and the stirring step are performed at the same time.

4. The method for manufacturing the thixomolding material according to claim 1, wherein in the debindering step, the mixture is heated at a temperature of 250° C. or higher.

5. The method for manufacturing the thixomolding material according to claim 4, wherein in the debindering step, the mixture is heated at a temperature of 450° C. or lower.

* * * * *